US005821952A

United States Patent [19]

Martenson et al.

[11] Patent Number: 5,821,952

[45] Date of Patent: Oct. 13, 1998

[54] METHOD FOR AUTOMATIC PRINT HEAD SPACING IN AN INK JET PRINTER

[75] Inventors: David D. Martenson, Milwaukie; Robert C. Tidrick, Portland; H. Erwin Grellmann, Aloha, all of Oreg.

[73] Assignee: Tektronix, Inc., Wilsonville, Oreg.

[21] Appl. No.: 709,066

[22] Filed: Sep. 6, 1996

[51] Int. Cl.[6] ..... B41J 25/308

[52] U.S. Cl. ..... 347/8; 400/55

[58] Field of Search ..... 347/8, 5, 1, 104; 400/55, 56, 57, 58, 59

[56] References Cited

U.S. PATENT DOCUMENTS

| | | | |
|---|---|---|---|
| 4,755,836 | 7/1988 | Ta et al. | 347/8 |
| 4,843,338 | 6/1989 | Rasmussen et al. | 346/140 |
| 4,990,004 | 2/1991 | Kawahara et al. | 400/56 |
| 5,009,526 | 4/1991 | Kirchhof | 400/56 |
| 5,227,809 | 7/1993 | Carpenter et al. | 346/1.1 |
| 5,468,076 | 11/1995 | Hirano et al. | 347/8 |
| 5,506,606 | 4/1996 | Saikawa et al. | 347/104 |

FOREIGN PATENT DOCUMENTS

| | | |
|---|---|---|
| 211481 | 12/1983 | Japan . |
| 212372 | 10/1985 | Japan . |
| 152682 | 9/1993 | Japan . |

OTHER PUBLICATIONS

IBM Corp. 1984, "IBM Technical Disclosure Bulletin", vol. 26 No. 12, May 1984 pp. 6373–6374 (2 pgs).

IBM Corp. 1988, "IBM Technical Disclosure Bulletin", vol. 30 No. 8, Jan. 1988, pp. 406–407 (2 pgs).

*Primary Examiner*—Benjamin R. Fuller
*Assistant Examiner*—Juanita Stephens
*Attorney, Agent, or Firm*—Charles F. Moore

[57] ABSTRACT

A method for setting a predetermined head-to-print medium distance without utilizing a media clamp is provided. A print medium support surface has a contact length that is less than the length of the print medium. The distance between the print head and the support surface is set to a minimum. Stationary rollers and arcuate guides direct the print medium between a spacing device and the support surface without utilizing a clamp. A shim is interposed between the spacing device and the print medium to move the print head away from the print medium. The shim is retracted leaving the print head spaced from the print medium by the predetermined head-to-print medium distance.

12 Claims, 4 Drawing Sheets

METHOD FOR AUTOMATIC PRINT HEAD SPACING IN AN INK JET PRINTER

TECHNICAL FIELD

The present invention relates to ink jet printers and, in particular, to a method for automatically setting a predetermined distance between an ink jet print head and a print medium on which an image is to be printed.

BACKGROUND OF THE INVENTION

Many computer printers, including some low resolution ink jet printers, shuttle a print head back and forth across a print medium (e.g., paper) to print graphics and text images thereon. Printing typically occurs while the print head is shuttled in each direction, thereby employing relatively fast bidirectional printing.

An ink jet printer projects microscopic ink droplets from the print head onto the paper to form a printed image. Since the print head is typically not in contact with the paper, the droplets are projected to the paper through air. Accordingly, there is a propagation time during which the droplets propagate from the print head to the paper. This propagation time is dependent upon the velocity at which the droplets are ejected from the print head and the distance between the print head and the paper (the head-to-print medium distance).

The print head is shuttled across the paper at a shuttling velocity. A droplet projected from the print head will have the shuttling velocity in the direction the print head is being shuttled. A droplet projected toward an image location on the paper must, therefore, be ejected from the print head at an ejection time that occurs before the print head is aligned with the image location. Nominally, the ejection time precedes the alignment of the print head with the image location by about the propagation time of the droplet.

When printing takes place in only one shuttle direction, all droplets are subjected to the same shuttling velocity. As a result, the alignment of droplets ejected during successive shuttles is substantially independent of the propagation time of the droplets.

In bidirectional printing, however, the ejected droplets travel in different trajectories during the successive shuttles in opposite directions. As a result, the alignment of droplets ejected during successive shuttles is dependent upon the propagation time of the droplets (i.e., the velocity at which the droplets are ejected from the print head and the head-to-print medium distance).

The velocity at which the droplets are ejected can be precisely controlled by the print head. Accordingly, the head-to-print medium distance must be accurately maintained to provide adequate alignment of the droplets ejected during successive shuttles in opposite directions. In low speed, low resolution ink jet printers of the type commonly available, the head-to-print medium distance can be maintained by a semi-rigid follower wheel that rolls across the paper with the print head as it is shuttled. In other low resolution printers, a manual adjustment cam of the type used on conventional typewriters allows a user to select the desired distance.

These conventional spacing mechanisms, however, do not provide spacing to within a tolerance adequate for high print quality bidirectional ink jet printers. Such printers can form images with 118 dots/cm (300 dpi) and greater and require that the distance between the print head and paper be maintained such that pixel convergence is achieved in bidirectional printing. These printers can also be adapted to print onto media having a wide range of thicknesses and sizes, including wide-format (B-and E-size) media.

U.S. Pat. No. 5,227,809 for an AUTOMATIC PRINT HEAD SPACING MECHANISM FOR INK JET PRINTER, assigned to the assignee of the present application, discloses an apparatus and method for setting the head-to-print medium distance within the required tolerances for high print quality printers. As shown in FIG. 1 of this patent, a media clamp 26 is utilized to receive and clamp a sheet of paper 16 against a support surface or drum 20. The media clamp 26 is received within a slot 28 in the drum 20 and secures the paper 16 to the outer surface 18 of the drum throughout the entire printing process. As illustrated in FIGS. 5A–C of this patent, the clamp 26 is also used to set the desired head-to-print medium distance.

With reference to FIG. 1 of the '809 patent, the contact length of the drum's outer surface 18, or the linear distance that is available to support the paper 16 without overlapping, is equivalent to the circumference of the drum 20. As shown in FIG. 1, the contact length (circumference) of the outer surface 18 is greater than the length of the paper 16. This allows the paper 16 to be clamped to the drum 20 throughout the entire printing process, after which the clamp 26 is released and the finished print is delivered to the user. It follows that this clamping mechanism and the associated method for setting the head-to-print medium distance requires that the contact length of the support surface be greater than the length of the print media.

In some ink jet printers, however, it is desirable to utilize a media support surface that has a contact length which is less than the length of the print media. For example, in wide-format (E-size) ink jet printers, it is commercially impractical to provide a media support surface having a contact length (circumference) that is greater than the length of the print media. Accordingly, these printers cannot use the above-described media clamp or the related method for setting the head-to-print medium distance as taught in the '809 patent.

Therefore, a need exists for an improved method for setting a predetermined head-to-print medium distance that does not require a media clamp to set the distance.

SUMMARY OF THE INVENTION

It is an aspect of the present invention to provide a method for setting a predetermined distance between a print head of an ink jet printer and a print medium.

It is another aspect of the present invention to provide a method for setting a predetermined head-to-print medium distance that does not require a media clamp.

It is a feature of the present invention that the method for setting a predetermined head-to-print medium distance may be utilized with media having a wide range of thicknesses and lengths.

It is an advantage of the present invention that the method for setting a predetermined head-to-print medium distance may be used in ink jet printers in which the media support surface has a contact length that is less than the length of the print media.

To achieve the foregoing and other aspects, features and advantages, and in accordance with the purposes of the present invention as described herein, an improved method for setting a predetermined head-to-print medium distance is provided. The method does not utilize or require a media clamp and may be used in ink jet printers in which the media support surface has a contact length that is less than the length of the print media.

Still other aspects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawings and descriptions will be regarded as illustrative in nature and not as restrictive. And now for a brief description of the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
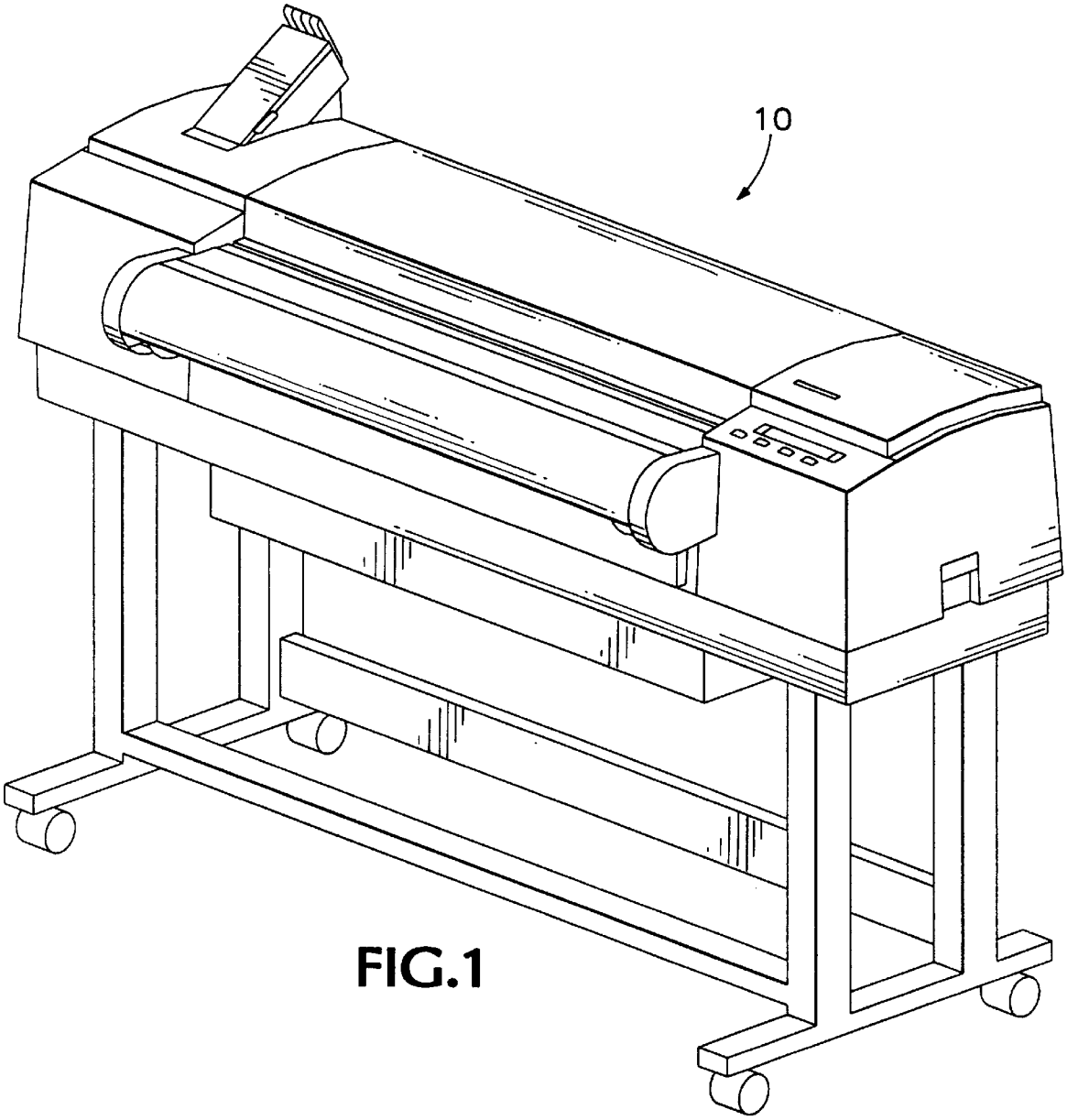
FIG. 1 is an overall perspective view of an ink jet printer that is particularly adapted for printing on wide format media and utilizes the method of setting a predetermined head-to-print medium distance of the present invention.
Figure 2:
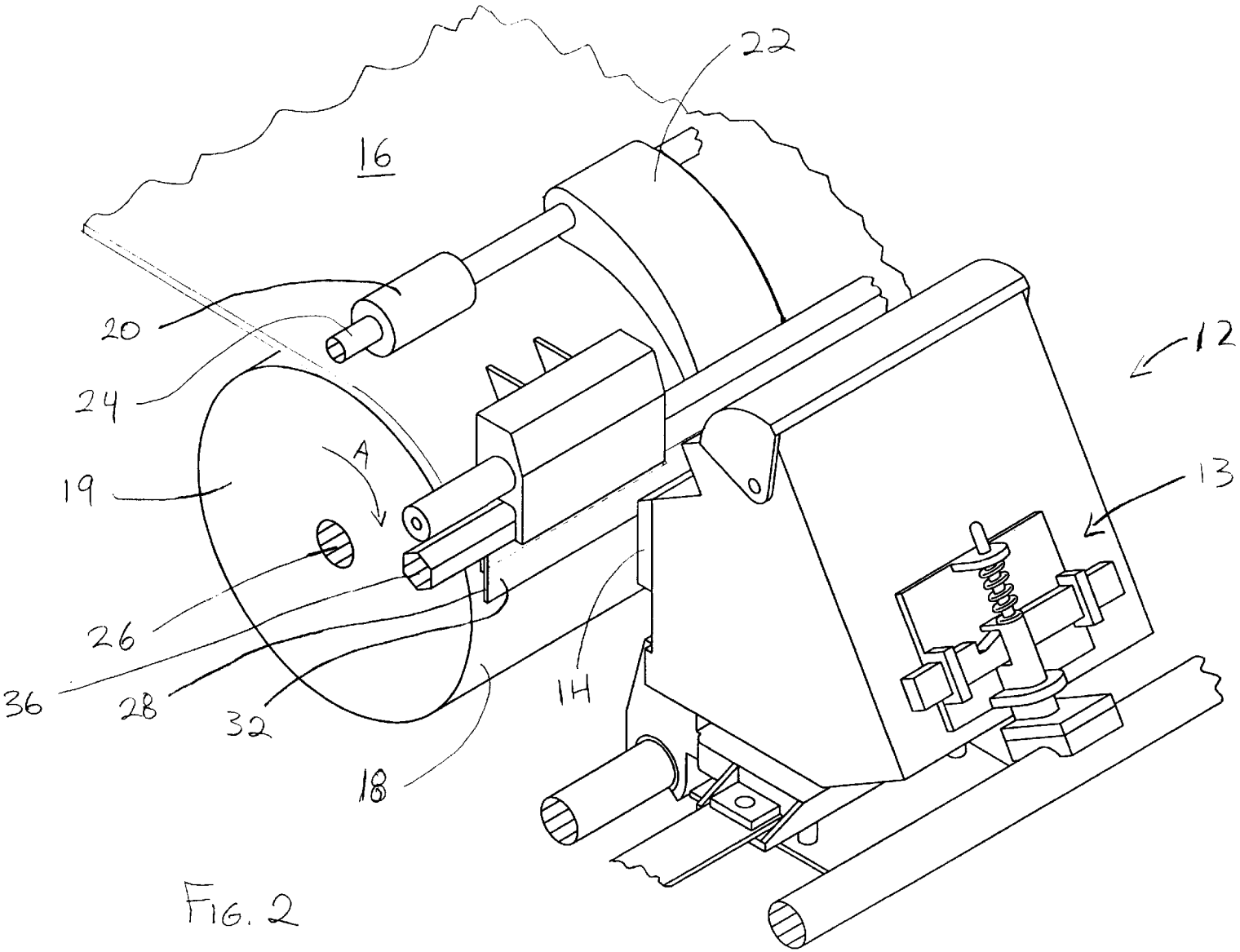
FIG. 2 is an isometric view showing a housing positioned between a movable print head assembly and a print media support surface.

FIG. 1 of the drawings shows an overall view of a wide format solid ink color printer, generally represented by the reference numeral 10, that utilizes the method for setting a predetermined head-to-print medium distance of the present invention. As shown in FIG. 2, the printer 10 includes a movable ink jet print head assembly, generally indicated by the reference numeral 12, that supports a print head 14. The print head assembly 12 includes a print head positioning system, generally indicated by reference numeral 13, that allows for an adjustable head-to-print medium distance. The print head positioning system 13 also maintains the predetermined head-to-print medium distance that is set by the method of the present invention as described herein. An example of this type of print head positioning system is disclosed in U.S. Pat. No. 5,227,809 for an AUTOMATIC PRINT HEAD SPACING MECHANISM FOR INK JET PRINTER and assigned to the assignee of the present invention. The '809 patent is hereby specifically incorporated by reference in pertinent part.

The print head 14 preferably includes a plurality of orifices (not shown) from which ink droplets are ejected toward a print medium such as a sheet of paper 16. It will be appreciated that the printer 10 is capable of printing on a variety of print media having a variety of thicknesses and sizes. The following description of the preferred embodiment refers specifically to paper 16 for purposes of simplicity.

The paper 16 is supported by a support surface 18 that preferably comprises the outer periphery of a drum 19. In an important aspect of the present invention, the paper 16 has a length (not shown) that is greater than the contact length (circumference) of the support surface 18. Alternatively expressed, the paper 16 cannot be wrapped around the entire circumference of the support surface 18 without overlapping. As explained above, this eliminates the possibility of using a media clamp that clamps the paper 16 throughout the entire printing process.

Figure 3:
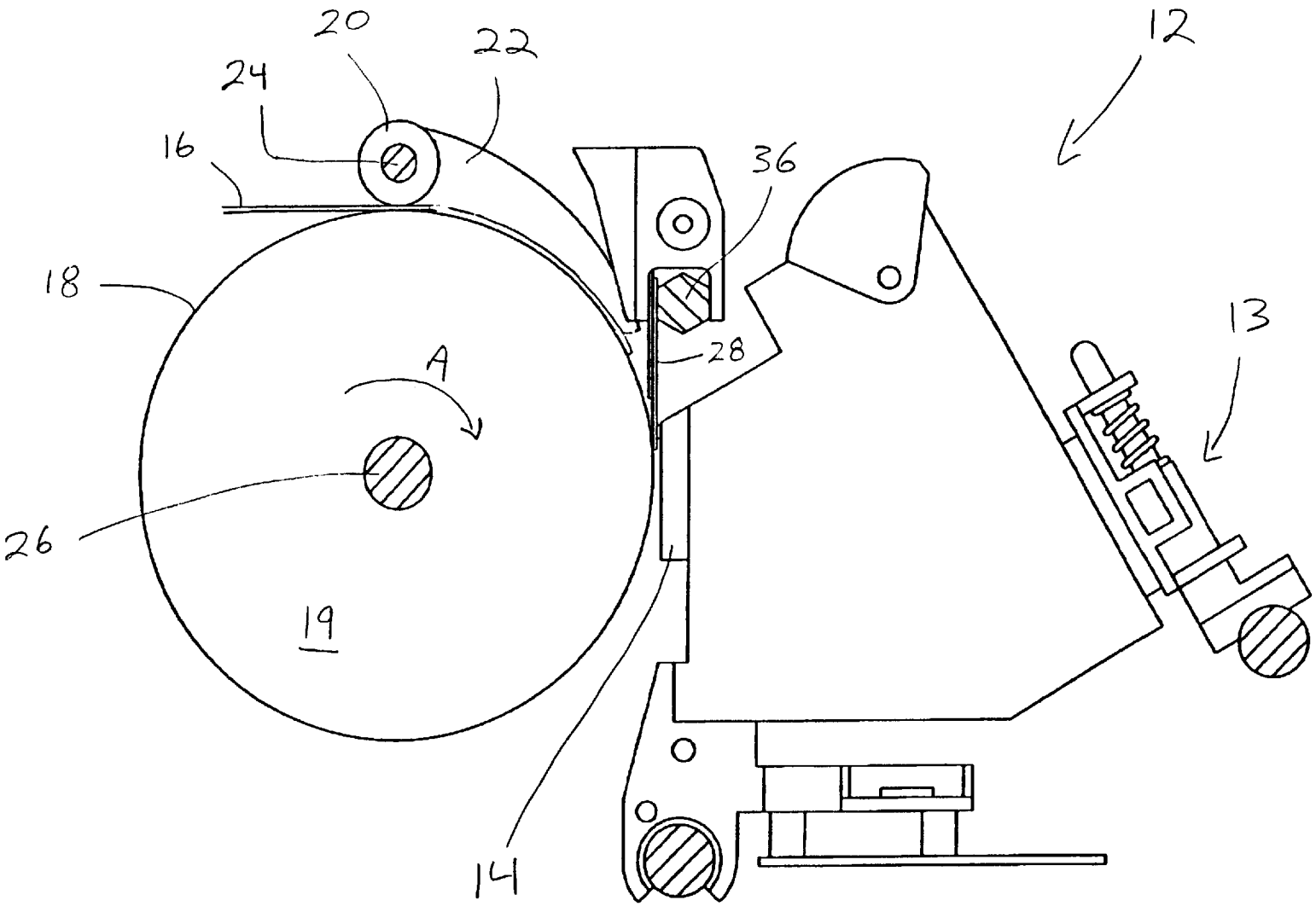
FIG. 3 is a side elevational view in partial cross section showing a spacing device extending downwardly from the housing and being positioned between the print head and the print media support surface.

As shown in FIGS. 2 and 3, stationary guide means are provided to receive the paper 16 and direct the paper between the print head 14 and the support surface 18. In the preferred embodiment, the stationary guide means comprises a plurality of passive rollers 20 and arcuate guides 22, only one of each being shown in FIG. 2. The rollers 20 and arcuate guides 22 pivot about an axis 24 and are positioned at spaced locations across the width of the support surface 18.

As best seen in FIG. 3, the roller 20 presses the paper 16 against the support surface 18 of the drum 19, and the arcuate guide 22 guides the paper along the support surface. As a motor (not shown) slowly rotates the drum 19 about a shaft 26 in the direction of action arrow A, the paper 16 is pulled under the roller 20 and guide 22 and is directed to follow the rotation of the support surface 18.

Figure 4A:
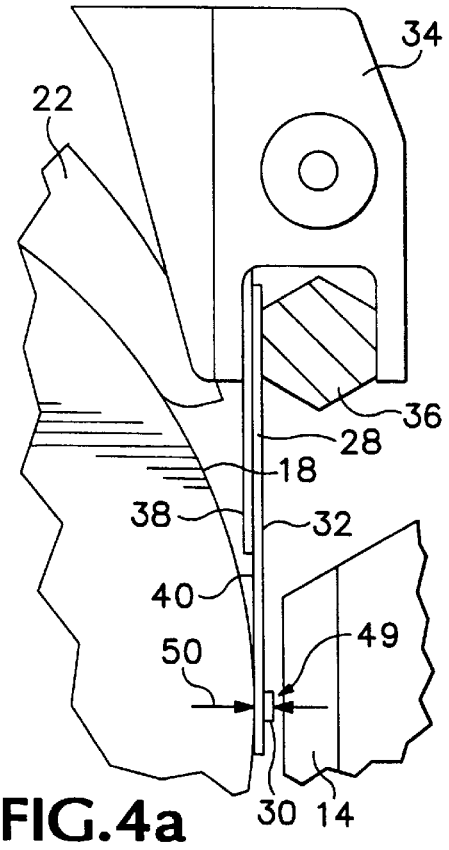
FIG. 4*a* is a schematic side view diagram showing the spacing device positioned between the print head and the media support surface, and showing the print head positioned a minimum distance from the support surface in accordance with the method of the present invention.

With reference now to FIG. 4*a*, the preferred embodiment of the method of the present invention utilizes a spacing device 28 that is positioned between the print head 14 and the support surface 18. It will be appreciated from the following description, however, that within the broader aspects of the present invention, the method of the present invention may also be practiced without the spacing device 28 and the steps associated therewith.

As best seen in FIG. 2, the spacing device 28 extends the entire width of the support surface 18 and is affixed to a rod 36 (see FIG. 3) that runs parallel to the support surface 18. With reference now to FIG. 4*a*, in the first step of the method of the present invention the print head 14 is positioned at a minimum distance from the support surface 18. In this position, a gap, generally indicated by reference numeral 49, is maintained between the print head 14 and a contacting surface 30 that protrudes from a rear face 32 of the spacing device 28. It will be appreciated that the gap 49 is exaggerated in FIG. 4*a* for purposes of clarity.

Figure 4B:
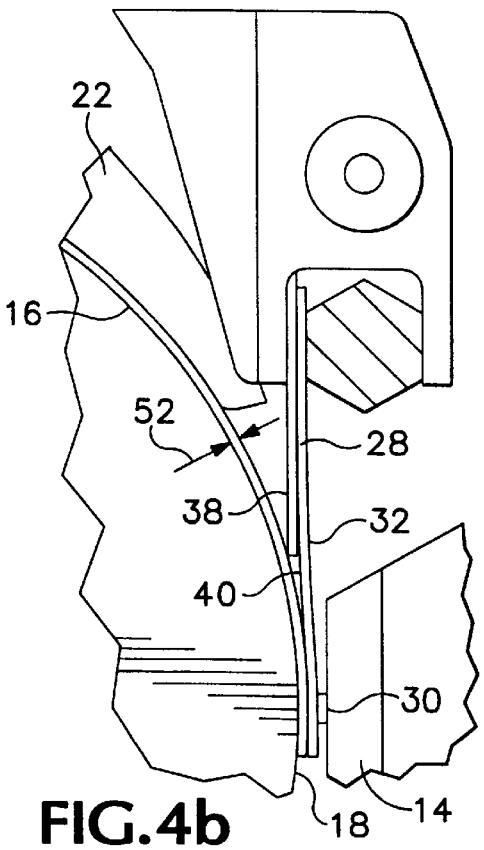
FIG. 4*b* is a schematic side view diagram showing a sheet of paper being inserted between the spacing device and the support surface to move the print head away from the support surface in accordance with the method of the present invention.

With the print head 14 positioned a minimum distance from the support surface 18, the distance between the print head and the support surface equals the thickness 50 of the spacing device 28/protruding contacting surface 30 plus the distance across the gap 49 between the print head 14 and the contacting surface 30. With reference to FIG. 4*b*, the sheet of paper 16 is now inserted between the spacing device 28 and the support surface 18. This moves the spacing device 28 away from the support surface 18 by a distance equal to the thickness 52 of the paper 16. As shown in FIG. 4*b*, the contacting surface 30 now contacts the print head 14 at a preselected location which is above the print head orifices (not shown) and away from ink carrying manifolds (not shown) within the print head. Advantageously, this reduces the possibility of damaging the print head as the predetermined head-to-print medium distance is set.

In an important aspect of the present invention, the sheet of paper 16 is inserted between the spacing device 28 and the support surface 18 without the use of a clamp or other media securing device moving with the paper 16. Advantageously, this allows the contact length or circumference of the support surface 18 to be less than the length of the paper 16. This, in turn, enables the printer 10 to accommodate wide format media having lengths greater than the contact length of the support surface 18.

Figure 4C:
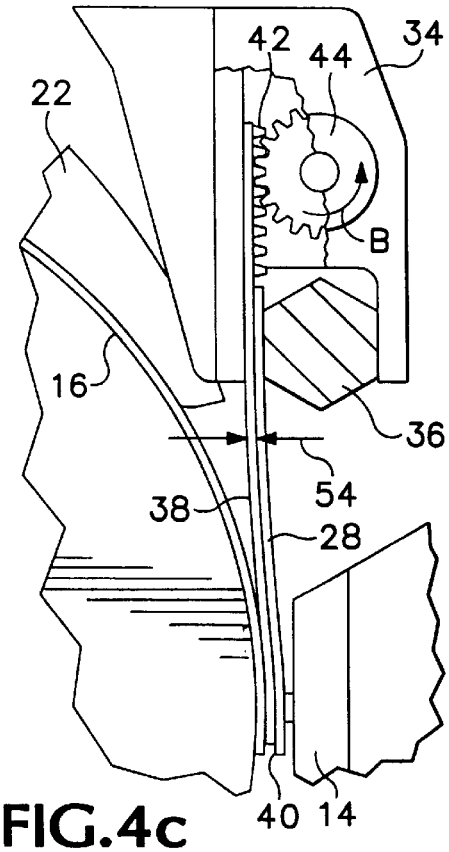
FIG. 4*c* is a schematic side view diagram showing a shim being interposed between the paper and the spacing device to move the print head away from the paper in accordance with the method of the present invention.

With reference now to FIG. 4*c*, a shim 38 is interposed between a front face 40 of the spacing device 28 and the paper 16. Preferably, one end of the shim 38 is contained in a housing 34 that is mounted on the rod 36. A moving means within the housing 34 advances the shim 38 downwardly between the front face 40 of the spacing device 28 and the paper 16. Preferably, the moving means comprises a rack 42 affixed to one end of the shim 38 and a mating pinion 44 that is rotatably secured within the housing 34. A motor (not shown) rotates the pinion 44 in the direction of action arrow B to move the shim 38 downwardly.

Figure 4D:
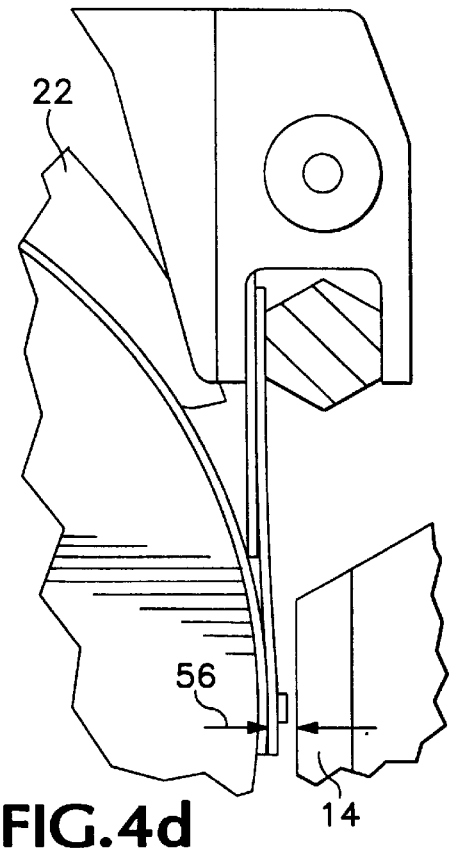
FIG. 4*d* is a schematic side view diagram showing the shim being removed from between the spacing device and the paper in accordance with the method of the present invention.

The shim 38 has a thickness 54 equal to the predetermined head-to-print medium distance minus the sum of the thickness 50 of the spacing device 28/protruding contacting surface 30 and the gap 49 between the print head 14 and the contacting surface 30. In this manner, as the shim 38 squeezes between the front face 40 of the spacing device 28 and the paper 16, the print head 14 is moved away from the support surface 18 by a distance equal to the shim thickness 54. Thus, when the shim 38 is removed from between the spacing device 28 and the paper 16, as shown in FIG. 4*d*, the print head 14 is now spaced from the paper 16 by the predetermined head-to-print medium distance 56. As FIG. 4*d* illustrates, the spacing device 28 is preferably biased toward the support surface 18 such that the spacing device exerts a gentle pressure on the paper 16 to keep the paper 16 in contact with the support surface 18.

With the predetermined head-to-print medium distance 56 now set, the drum 19 is rotated in the direction of action arrow A (see FIG. 2) to advance the paper 16 past the print head so that printing may begin. Supplementary paper guides (not shown) engage the paper 16 as it advances past the print head 14 to keep the paper in contact with the support surface 18 and maintain the predetermined head-to-print medium distance.

While the invention has been described above with reference to specific embodiments thereof, it is apparent that many changes, modifications and variations in the materials, arrangement of parts and steps can be made without departing from the inventive concepts disclosed herein. For example, as mentioned above, the method of the present invention may be practiced without utilizing the spacing device 28. In this case, when the distance between the print head 14 and the support surface 18 is set to a minimum, the print head is in contact with the support surface. The paper 16 and the shim 38 are then interposed between the support surface 18 and the print head 14, with the shim having a thickness equal to the predetermined head-to-print medium distance. When the shim is then removed, the predetermined head-to-print medium distance is now set.

The spirit and broad scope of the appended claims is intended to embrace this and all other changes, modifications and variations that may occur to one of skill in the art upon a reading of the disclosure.

Having thus described the invention, what is claimed is:

1. A method for setting a predetermined head-to-print medium distance independent of a thickness of a print medium in an ink jet printer having a movable print head for ejecting ink at the print medium, the print medium having a length, the print head and the print medium being spaced apart by an adjustable head-to-print medium distance, the method comprising the steps of:

providing a support surface for supporting the print medium, the support surface having a contact length that is less than the length of the print medium;

providing stationary guide means for guiding the print medium between the print head and the support surface;

providing a spacing device between the print head and the support surface, the spacing device having a thickness;

positioning the print head at a minimum distance from the support surface such that a gap is maintained between the print head and the spacing device;

inserting the print medium between the spacing device and the support surface without utilizing a clamp;

interposing between the spacing device and the print medium a shim having a thickness that is equal to the predetermined head-to-print medium distance minus a sum of the thickness of the spacing device and the gap between the print head and the spacing device, whereby the print head is moved away from the print medium such that the distance between the print head and the print medium equals the predetermined head-to-print medium distance; and removing the shim from between the spacing device and the print medium, whereby the predetermined head-to-print medium distance is set.

2. The method of claim 1 further including the step of providing moving means for moving the shim between the print head and the print medium.

3. The method of claim 2 wherein the step of providing moving means further comprises providing a rack attached to one end of the shim and a pinion engaging the rack.

4. The method of claim 3 wherein the step of providing stationary guide means further comprises providing a roller in contact with the support surface.

5. The method of claim 4 wherein the step of providing stationary guide means further comprises an arcuate guide in contact with the support surface.

6. The method of claim 5 wherein the step of providing a spacing device further includes providing a contacting surface that contacts the print head when the distance between the print head and the spacing device is set to a minimum.

7. The method of claim 6 further including the step of biasing the spacing device toward the support surface.

8. A method for setting a predetermined head-to-print medium distance independent of a thickness of a print medium in an ink jet printer having a movable print head for ejecting ink at the print medium, the print medium having a length, the print head and the print medium being spaced apart by an adjustable head-to-print medium distance, the method comprising the steps of:

providing a support surface for supporting the print medium, the support surface having a contact length that is less than the length of the print medium;

providing stationary guide means for guiding the print medium between the print head and the support surface;

setting the distance between the print head and the support surface to a miniumum;

inserting the print medium between the print head and the support surface without utilizing a clamp;

interposing between the print head and the print medium a shim having a thickness that is equal to the predetermined head-to-print medium distance to thereby move the print head away from the print medium by the predetermined head to print medium distance; and removing the shim from between the print head and the print medium, whereby the head-to-print medium distance is set.

9. The method of claim 8 further including the step of providing moving means for moving the shim between the print head and the print medium.

10. The method of claim 9 wherein the step of providing moving means further comprises providing a rack attached to one end of the shim and a pinion engaging the rack.

11. The method of claim 10 wherein the step of providing stationary guide means further comprises providing a roller in contact with the support surface.

12. The method of claim 11 wherein the step of providing stationary guide means further comprises providing an arcuate guide in contact with the support. surface.

* * * * *